US006668770B2

(12) United States Patent
Carlsson et al.

(10) Patent No.: US 6,668,770 B2
(45) Date of Patent: Dec. 30, 2003

(54) TWO-STROKE INTERAL COMBUSTION ENGINE

(75) Inventors: Bo Carlsson, Floda (SE); Hans Ström, Kode (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 10/064,431

(22) Filed: Jul. 12, 2002

(65) Prior Publication Data

US 2003/0005895 A1 Jan. 9, 2003

Related U.S. Application Data

(63) Continuation-in-part of application No. PCT/SE00/00059, filed on Jan. 14, 2000.

(51) Int. Cl.[7] ..... F02B 33/04

(52) U.S. Cl. ..... 123/73 A; 123/73 R; 123/73 PP; 123/65 A; 123/65 P

(58) Field of Search ..... 123/73 PP, 73 R, 123/73 A, 65 A, 65 P

(56) References Cited

U.S. PATENT DOCUMENTS 968,200 A 8/1910 Scott (List continued on next page.)

FOREIGN PATENT DOCUMENTS

AT 394755 B 11/1991

(List continued on next page.)

OTHER PUBLICATIONS

F. W. Lanchester and R. H. Pearsall, The Institution of Automobile Engineers. An Investigation Of Certain Aspects Of The Two–Stroke Engine For Automobile Vehicles, Feb. 1922, pp. 55–62, The Automobile Engineer.

(List continued on next page.)

*Primary Examiner*—Noah P. Kamen
(74) *Attorney, Agent, or Firm*—Howrey Simon Arnold & White LLP

(57) ABSTRACT

Crankcase scavenged two-stroke internal combustion engine, in which at least one piston ported air passage, with length $L_{ai}$, is arranged between an air inlet (2) and each scavenging port (31, 31') of a number of transfer ducts (3, 3'), with length $L_s$, from the scavenging port to the crankcase. The air passage is arranged from an air inlet (2) equipped with a restriction valve (4), controlled by at least one engine parameter, for instance the carburetor throttle control. The air inlet extends via at least one connecting duct (6, 6') to at least one connecting port (8, 8') in the engine's cylinder wall (12). The connecting port (8, 8') is arranged so that it in connection with piston positions at the top dead center is connected with flow paths (10, 10') embodied in the piston (13), which extend to the upper part of a number of transfer ducts (3, 3'). Each flow path of the piston is arranged so that the air supply is given an essentially equally long period, counted as crank angle or time, as the engine's inlet (22–25), and the length of the inlet into which fuel is added, Li, is greater than 0.6 times the total length of the piston ported air passage $L_{ai}$ and the length of the transfer duct $L_s$, i.e. $0.6\times(L_{ai}+L_s)$ but smaller than 1.4 times the same length, i.e. $1.4\times(L_{ai}+L_s)$.

14 Claims, 2 Drawing Sheets

U.S. PATENT DOCUMENTS

| | | | | |
|---|---|---|---|---|
| 980,134 | A | 12/1910 | Springer | |
| 1,113,456 | A | 10/1914 | McIntosh | |
| 1,121,584 | A | 12/1914 | Harper, Jr. | |
| 2,317,772 | A | 5/1941 | Huber et al. | |
| 4,067,302 | A | 1/1978 | Ehrlich | |
| 4,075,985 | A | 2/1978 | Iwai | |
| 4,176,631 | A | 12/1979 | Kanao | |
| 4,248,185 | A | 2/1981 | Jaulmes | 123/73 R |
| 4,253,433 | A | 3/1981 | Blair | |
| 4,306,522 | A | 12/1981 | Fotsch | |
| 4,340,016 | A | 7/1982 | Ehrlich | |
| 4,481,910 | A | 11/1984 | Sheaffer | |
| 4,969,425 | A | 11/1990 | Slee | |
| 4,987,864 | A | 1/1991 | Cantrell et al. | |
| 5,379,732 | A | 1/1995 | Mavinahally et al. | |
| 5,425,346 | A | 6/1995 | Mavinahally | 123/568 |
| 5,645,026 | A | 7/1997 | Schlessmann | |
| 5,857,450 | A | 1/1999 | Staerzl | |
| 6,016,776 | A | 1/2000 | Jonsson | |
| 6,085,703 | A | 7/2000 | Noguchi | |
| 6,112,708 | A | 9/2000 | Sawada et al. | |
| 6,216,650 | B1 | 4/2001 | Noguchi | |
| 6,240,886 | B1 | 6/2001 | Noguchi | |
| 6,289,856 | B1 | 9/2001 | Noguchi | |

FOREIGN PATENT DOCUMENTS

| | | | |
|---|---|---|---|
| DE | 420100 | | 10/1925 |
| DE | 470603 | | 1/1929 |
| DE | 748415 | | 11/1944 |
| DE | 749456 | | 11/1944 |
| DE | 2151941 | | 4/1973 |
| DE | 2650834 | | 6/1977 |
| DE | 3329791 | A1 | 2/1985 |
| DE | 3722424 | A1 | 1/1988 |
| DE | 19857738 | A1 | 7/1999 |
| EP | 0337768 | A2 | 10/1989 |
| EP | 0391793 | A1 | 10/1990 |
| EP | 0971110 | A1 | 1/2000 |
| EP | 0997620 | A2 | 5/2000 |
| FR | 784866 | | 7/1935 |
| FR | 1434710 | | 2/1966 |
| GB | 2022699 | A | 12/1979 |
| GB | 2130642 | A | 6/1984 |
| JP | 57183520 | A | 11/1982 |
| JP | 58005423 | | 1/1983 |
| JP | 07269356 | | 10/1995 |
| JP | 2000170611 | | 6/2000 |
| JP | 2000328945 | | 11/2000 |
| JP | 2000337154 | | 12/2000 |
| WO | WO 89 02031 | A1 | 3/1989 |
| WO | 9857053 | A1 | 12/1998 |
| WO | WO 0043650 | A1 | 7/2000 |
| WO | WO 00 65209 | A1 | 11/2000 |
| WO | WO 01 25604 | A1 | 4/2001 |
| WO | WO 01 44634 | A1 | 6/2001 |

OTHER PUBLICATIONS

Dr.–Ing. Kurt Blume, Gaiβach, Zweitakt–Gemischspülung mit Spülvorlage, 1972, pp. 475–479, DK 621.43—144.4.058.2, Motortechnische Zeitschrift 74 (1972) 12.

Prof.Dr.H.P.Lenz, Dipl.Ing.G.Bruner, Dipl.Ing. F. Gerstl, Abschluβbericht, zum Forschungsauftrag sur Entwicklung eines Ladungswechselverfahrens mit Spülvorlage für Motorfahrräder, Mar. 1978, pp. 1–16, Tables I–III, Bild 1–17, Z–NR. B0644, Istitut Für Verbrennungskraftmaschinen Und Kraftfahrewsen. Technische Universität Wien.

Dipl.–Ing. Friedrich Gerstl, Dissertation, Massnahmen Zur Abgas –Und Verbrauchsverbesserung Von Kleimvolumigen Zweitakt –Ottomotoren, ausgefuhrt sum Zwecke, der Erlangung des akademischen Grades eines Doktors der technischen Wissenschaften, eingereicht an der Technischen Universitat in Wein, Aug. 1979.

J. Meyer, Air–Head Charge Stratification Of A Two–Stroke Outboard Engine, Mar. 1992, The Queen's University of Belfast, School of Mechanical & Manufacturing Engineering.

Dr. R. Pischinger, $5^{TH}$ Graz Two–Wheeler Symposium, Apr. 22–23, 1993, Heft 65, Technische Universitat Graz, Mitteilungen des Institutes fur Verbrennungskraftmaschinen und Thermodynamik, Belfast, Ireland.

TWO-STROKE INTERAL COMBUSTION ENGINE

CROSS REFERENCE TO RELATED APPLICATIONS

The present application is a continuation-in-part of PCT/SE00/00059, filed Jan. 14, 2000 and published in English pursuant to PCT Article 21(2), and which is expressly incorporated herein by reference in its entirety.

BACKGROUND OF INVENTION

1. Technical Field

The subject invention relates to a two-stroke crankcase scavenged internal combustion engine in which a piston ported scavenging air passage is arranged between a scavenging air inlet and the upper part of one or more transfer ducts. Fresh air is added proximate a top end of the transfer ducts and is intended to serve as a buffer against the air/fuel mixture below. Mainly, this buffer is lost out through the exhaust outlet during the scavenging process. In this way, both fuel consumption and exhaust emissions are reduced; less unburned fuel is released to the atmosphere which is wasted and is a pollutant. In a preferred application, the engine is intended to be incorporated into a handheld working tool.

2. Background of the Invention

Internal combustion engines of the two-stroke crankcase scavenged type are known. This configuration reduces fuel consumption and exhaust emissions, but in known designs, it is difficult to control the air/fuel ratio in these type of engines.

U.S. Pat. No. 5,425,346 discloses an engine with a somewhat different design than that which is described above. In this patent, channels are arranged in the piston of the engine, which at specific piston positions are aligned with ducts in the cylinder. Fresh air and/or exhaust gases can be added to the upper part of the transfer ducts. This only happens at the specific piston positions where the channels in the piston and the ducts in the cylinder are aligned. This happens both when the piston moves downwards and when the piston moves upwards far away from the top dead center position. To avoid unwanted flow in the wrong direction in the latter case, check valves are arranged at the inlet to the upper part of the transfer ducts. Inclusion of this type of check valve, which is often of the reed valve type, has a number of disadvantages. For instance, these check valves frequently have a tendency to come into resonant oscillations and can have difficulties coping with the high rotational speeds or cycles at which many two-stroke engines can operate. Besides, such a valve's inclusion results in added cost and an increased number of engine components. The amount of fresh air added is varied through the use of a variable inlet; for example, an inlet that can be advanced or retarded in the work cycle. This is, however, a very complicated solution.

International Patent Application WO 98/57053 shows several different embodiments of an engine in which air is supplied to the transfer ducts via L-shaped or T-shaped channels in the piston. In this way, check valves are avoided. In all embodiments, the piston channel has, where it meets the respective transfer duct, a very limited height, which is essentially equal to the height of the actual transfer port. A consequence of this design is that the passage for the air delivery through the piston to the transfer port is opened significantly later than is the passage for the air/fuel mixture to the crankcase. The period for the air supply is consequently significantly shorter than the period for the supply of air/fuel mixture, where the period can be counted as crank angle or time. This can complicate the control of the total air-fuel ratio of the engine. This also results in that the amount of air that can be delivered to the transfer duct is significantly limited since the underpressure driving this additional or scavenging air has decreased substantially because the engine air inlet port has already been open during a certain period of time when the scavenging air supply is also opened. This implies that both the period and the driving force for the scavenging air supply are small in this configuration. Furthermore, the resistance to air flow in the L-shaped and the T-shaped ducts, as shown, becomes relatively high. This resistance is at least partly due to the cross section of the duct being small close to the transfer port and partly because of the sharp bend created by the L-shape or T-shape. In all, this contributes to increasing the flow resistance and to reducing the amount of air that can be delivered to the transfer ducts. This, in turn, reduces the possibilities to reduce fuel consumption and exhaust emissions by the arrangement.

SUMMARY OF INVENTION

The objects of the present invention(s) are achieved for a two-stroke combustion engine in accordance with the descriptions contained herein. The invention may take the form of a two-stroke combustion engine configured to include one or more piston ported air passages, each arranged from a scavenging air inlet that is equipped with a restriction valve. The restriction valve(s) are controlled by at least one engine parameter, such as the carburetor throttle control. The scavenging air inlet is connected to at least one connecting duct, each of which is channeled to a connecting port in the cylinder wall of the engine. The arrangement is configured so that each connecting port is connected with a flow path embodied in the piston when the piston is proximate the top dead center position. Each flow path in the piston extends to an upper part of a transfer duct fluidly connecting the engine's cylinder to the crankcase. In one embodiment, the flow paths each take the form of a recess in a peripheral surface of the piston. Each recess is configured to, at certain times, commonly overlay a paired connecting and scavenging port. The recess moves through registration with a paired set of ports permitting scavenging air to be supplied toward the crankcase. Based on the arrangement thus disclosed, the period during which the engine air is provided to establish the air/fuel mixture and the period during which scavenging air is delivered to the engine in each cycle can be manipulated by varying one or more of the described features.

Regarding two-stroke internal combustion engines that are employed for powering hand-held machines, there are two general performance categories. A first of the two categories is typified by professional debranching saws in which quick acceleration to high operating speeds is desired. It is also desired that the greatest operating torques and power be produced at these higher running speeds, as opposed to the lower speeds that these type of engines pass through on the way up to high-speed operation. For reference purposes henceforth, these types of engines will be referred to as high speed/high torque engines. The second category of two-stroke engines is configured to produce maximum torque at lower speed. Tools that regularly employ such engines are typified by cutting saws such as those used to cut concrete. Operational speeds of these engines is desirably kept low, while at the same time delivering maximum torque and power in these low speed ranges. Additionally, the power curve for these types of engines can be characterized as having increasing torque ratios for decreasing engine speeds within relevant operational ranges. For reference purposes henceforth, these types of engines will be referred to as low speed/high torque engines.

The manipulation to two engine parameters has been found particularly useful in the design and control of these two-stroke internal combustion engines. With respect to the engines' design, the length of the channel for the fuel/air mixture can be adjusted with respect to the length of the channel for the scavenging air. With respect to the engines' control or operation, the relative time period for the supply of the fuel/air mixture versus the time period for the supply of scavenging air can be advantageously manipulated. In both instances, that is for the design and control engine parameters, a preferred range of values has been identified that encompasses both the high speed/high torque engines, as well as the low speed/high torque engines. Within these broader ranges, however, particularly preferred sub-ranges have been identified for the two engine groups.

In this regard, it has been found advantageous to regulate the relative periods of scavenging air supply time to engine air supply time for the air/fuel mixture to between about 0.7 and about 1.2. A particularly advantageous ratio has been discovered to be between about 0.7 and about 1.0 for high speed/high torque engines and between about 0.9 and about 1.2 for low speed/high torque engines. This variable can be manipulated to produce desired characteristics under different operating conditions; for example, one ratio may be induced for potentiated performance during maximum torque production when high amounts of air are desired to be taken into the crankcase for having the overall effect of leaning the fuel/air mixture supplied to the engine's cylinder. For simplicity, these relative periods can be measured based on angular travel of the crank and/or time.

Regarding the relative channel lengths, it has been found advantageous to configure the channels so that the relative length of the channel for the fuel/air mixture to the length of the channel for the scavenging air is between about 0.3 and about 1.4. A particularly advantageous ratio has been discovered to be between about 0.4 and about 0.5 for high speed/high torque engines and between about 0.3 and about 0.6 for low speed/high torque engines. As with manipulation of the relative supply time periods addressed immediately above, this variable can also be manipulated to produce desired characteristics under different operating conditions.

With respect to the relative lengths of the two flow channels or passages, the passage through which scavenging air travels is generally measured between the scavenging air inlet, usually controlled by a restrictive valve, and a terminal inlet port at the crankcase. Along this path, the scavenging air traverses the connecting duct, the flow path at the piston, and the transfer duct. The passage through which the engine air, and then the engine air/fuel mixture travels is generally measured from the engine air inlet, passed the station where fuel is added, and on to a port proximate the engine's crankcase.

In an exemplary embodiment, the length of the engine air passage into which fuel is added, $L_i$, is greater than 0.6 times the total length of the piston ported air passage $L_{ai}$ and the length of the transfer duct $L_s$, i.e. $0.6\times(L_{ai}+L_s)$ but smaller than 1.4 times the same length, i.e. $1.4\times(L_{ai}+L_s)$.

By adapting the length of the ducts leading the air to the crankcase in relation to the length of the inlet duct, the control of the engine can be simplified. By adapting these two duct systems in relation to each other, the flow in each system will vary concurrently with the flow in the other system. In this manner a carburetor in the inlet system could supply the correct amount of fuel to the engine irrespective of load variations and other factors impacting the engine's operation. In one respect, high speed engines having relatively short, low volume, scavenging channels can be dimensioned so that they do not hold all the scavenging air that is delivered to the engine during maximum torque speed because of their being too small, but that can hold all of the scavenging air, which is a lesser amount, delivered at maximum power speed. Manipulation of these relative lengths is an aspect of the presently disclosed invention used to adjust the fuel/air ratio curve of an engine. Because the total fuel/air ratio is usually at its richest around maximum torque demand conditions, manipulation of the relative lengths of the channels is taught to be manipulated for desirably leaning the overall mixture, including mixing of the fuel/air supply from the carburetor with scavenging air amounts at the crankcase.

Because at least one connecting port in the engine's cylinder wall is arranged so that it in connection with piston positions at the top dead center is connected with flow paths embodied in the piston, the supply of fresh air to the upper part of the transfer ducts can be arranged entirely without check valves. This can take place because at piston positions at or near the top dead center there is an underpressure in the transfer duct in relation to the ambient air. Thus a piston ported air passage without check valves can be arranged, which is a substantial advantage. Because the air supply has a relatively long period, a large amount of air can be delivered so that a high exhaust emissions reduction effect can be achieved. Control is applied by means of a restriction valve in the air inlet, controlled by at least one engine parameter. Such control is of a significantly less complicated design than a variable inlet. The air inlet has preferably two connecting ports, which in one embodiment are so located that the piston is covering them at its bottom dead center. The restriction valve can suitably be controlled by the engine speed, alone or in combination with another engine parameter. These and other characteristics and advantages are clarified in the detailed description of the different embodiments, supported by the included drawing figures.

BRIEF DESCRIPTION OF DRAWINGS

The invention will be described in greater detail in the following by means of various embodiments thereof with reference to the accompanying drawing figures. For parts that are symmetrically located on the engine, the part on the one side has been given a numeric designation while the part on the opposite side has been given the same designation, but with a prime symbol, '. In the drawings, the parts indicated with a primed reference numeral are to be understood as being located above the plane of the paper, and therefore not visible; that is, they are not shown in the drawings.

DETAILED DESCRIPTION

Figure 1:
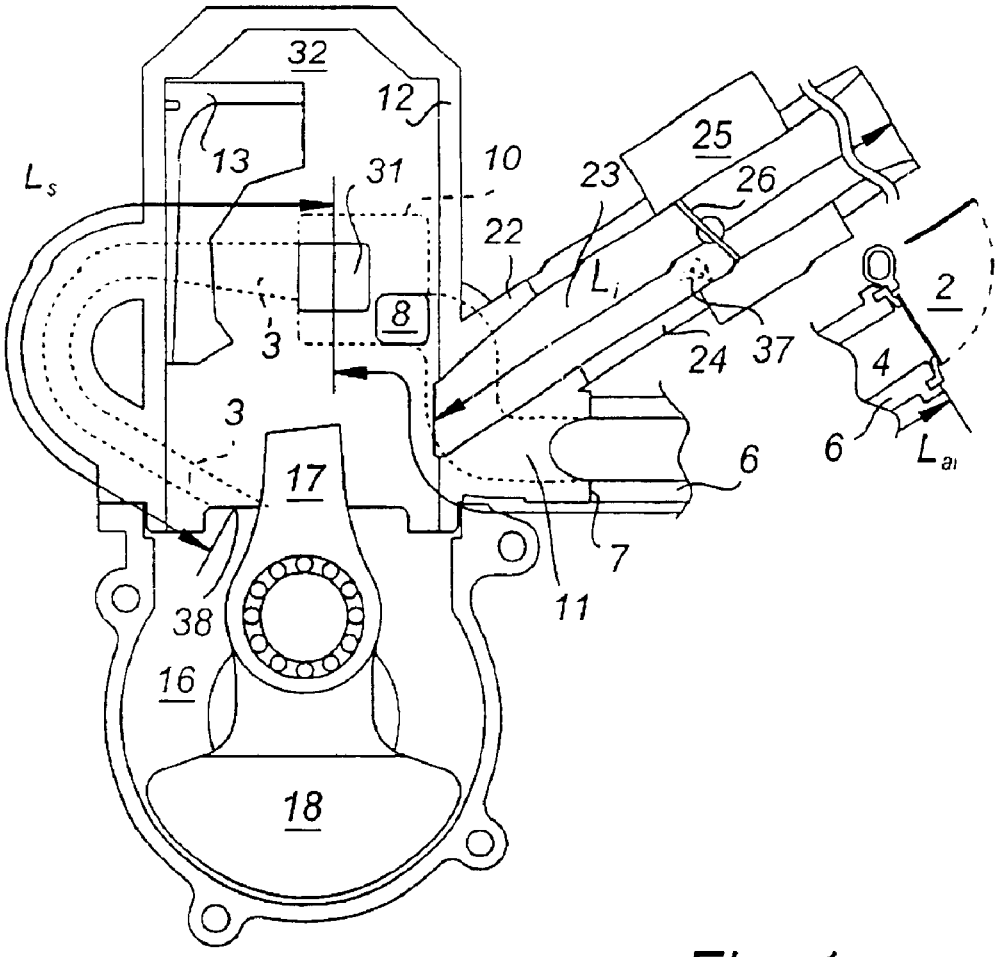
FIG. 1 shows an elevational schematic view, in partial cutaway and partial cross-section, of an engine configured according to the invention. The piston is shown in an approximately top dead center position.

An internal combustion engine configured according to the present invention is schematically illustrated in FIG. 1.

It is of two-stroke type and has transfer ducts 3,3'. The latter is not visible in the drawing since it is located above the plane of the paper. The engine has a cylinder 15, a crankcase 16, and a piston 13 connected to a crank mechanism 18 via connecting rod 17. Furthermore, the engine has an engine inlet tube 22 that together with an intermediate section 24 and carburetor assembly 25, including a throttle valve 26, establish an engine air passage 23. A distal end of this passage 23 is open at an inlet port. Usually, an inlet muffler with a filter is connected to, and upstream of the inlet port. These ancillary components are not shown for the sake of simplicity and clarity. The same applies for an exhaust port, an exhaust duct and a muffler to the engine, but whose assembly is well appreciated by those persons skilled in this art. As is conventional, such an exhaust system is located on the opposite side of the cylinder to the engine air inlet arrangement. As shown, the piston 13 has a planar upper surface without steps or other modification thereby assuring equal cooperation with the various cylinder ports wherever they are located around the cylinder and piston periphery. A height of the engine body is therefore approximately unchanged in comparison to conventional engine designs. The transfer ducts 3,3' have scavenging ports 31,31' at the engine's cylinder wall 12. The engine has a combustion chamber 32 with a spark plug, which is not shown, but conventional in design.

According to at least one embodiment of the invention, a scavenging air inlet 2, equipped with a restriction valve 4, is provided for supplying fresh air to the cylinder 15. The scavenging air inlet 2 is placed in fluid communication with the engine's cylinder 15 via a connecting duct 6 which connects to the cylinder 15 at an outer connecting port 7 of the cylinder 15. A piston ported air passage is defined from the inlet 2, through the connecting duct 6, across the cylinder 15 at connecting port 7, and up to the scavenging port 31. A length of this piston ported air passage is defined as $L_{ai}$. The term "port," hence forward, is utilized to mean a port or aperture formed at the inside of the cylinder 15, and corresponding ports on the outside of the cylinder are referred to as similarly named outer connecting ports. As described with respect to the engine air inlet, the scavenging air inlet 2 is suitably connectable to an inlet muffler, with filter if necessary, so that cleaned fresh air is taken into the engine. If the requirements are lower, such upstream air treatment will not be necessary. Because this adaptation is well appreciated in the art, the inlet muffler is not shown for the sake of simplicity and clarity.

According to this configuration, the connecting duct 6 is advantageously connected to the outer connecting port 7. At, or after, this outer connecting port 7, the piston ported scavenging air passage can divide into a plurality of branches 11, 11', each of which lead to a respective connecting port 8,8' at the interior of the cylinder 15. If two such branches are provide, the pair will typically be located symmetrically about the cylinder 15. The outer connecting port 7 can thus be located under the engine inlet tube 22 providing a number of advantages such as lower air temperatures and an efficient utilization of space at the engine-incorporating handheld working tool, which usually has a fuel tank.

It should be appreciated, however, that the outer connecting port 7 can also be located above the inlet tube 22, and may thus be directed more horizontally. Regardless of the elevational position of the two outer connecting ports 7,7', each can easily be located at a side of the inlet tube 22 via the configuration of the branches 11,11.

Flow paths 10,10' are arranged in the piston 13 so that when the piston 13 is in, or proximate top dead center positions, a fluid connection is established between connecting ports 8,8' to upper parts of respective transfer ducts 3,3' at the scavenging ports 31,31'. In a preferred embodiment, the flow paths 10,10' are established via means of local recesses in the piston 13. As shown, the recess forming the flow path 10 is of sufficient size and configuration to commonly over both a connecting port 8 and a scavenging port 10 thereby establishing fluid communication therebetween when the recess comes into registration therewith. By this recess-type design of the flow path, the piston can be simply manufactured, and usually cast to include one or more local recesses.

Usually the connecting ports 8,8' are so located in an axial direction of the cylinder 15 that the piston 13 covers those connecting ports 8,8' when positioned at, or near the bottom dead center position. Thereby exhaust gases cannot penetrate into the connecting port 8,8' and further towards an eventual intake air filter. But it is also possible that the connecting ports 8,8' can be located so high up in the cylinder 15 that they are in some part opened when the piston 13 is located at or near the bottom dead center position. This adaptation can be included so that a desirable amount of exhaust gases will be supplied into the connecting duct 6. Connecting ports 8,8' that are located relatively high in the cylinder 15 can also help reduce flow resistance of air at the changeover from connecting port 8,8' to scavenging port 31,31' at the recess 10,10' in the periphery of the piston 13.

The period of scavenging air supply from the connecting ports 8,8' to the scavenging ports 31,31' is important and is to a great extent determined by the flow paths 10,10' in the piston 13; that is, exemplarily, the illustrative recess 10,10' in the piston 13.

Preferably the upper edge of the recess 10,10' is located sufficiently high in the piston 13 so that when the piston 13 is moving upwards from the bottom dead center position, this upper edge of the recess 10,10' extends to the lower edge of a respective port 31,31' while at the same time a lower edge of the piston 13 reaches a lower edge of the engine inlet port thereby opening access to the engine's air/fuel mixture supply. In this way the scavenging air connection between the connecting ports 8,8' and the scavenging ports 31,31' is opened at the same time as the engine inlet for the air/fuel mixture is opened. When the piston moves down again after being at the top dead center position, then the scavenging air connection and the air/fuel inlet will be shut off at the same time and thus be given an essentially equally long period of openness. It has been found to be desirable for the scavenging air inlet period and the engine air/fuel inlet period to be essentially equally long. Preferably, the scavenging air period is approximately 90%–110% of the engine air/fuel mixture inlet period. It should be appreciated that both of these periods are limited by the maximum period during which the pressure is low enough in the crankcase to enable a maximal inflow. Both periods, however, are preferably maximized.

The position of the upper edge of the recess 10,10' determines how early registration will come with each of the scavenging port 31,31'. Consequently, the recess 10,10' in the piston 13 that meets a scavenging port 31,31' advantageously has an axial height locally at this scavenging port 31,31' that is greater than one and one-half times the height of that scavenging port 31,31', and preferably greater than two times the height of the scavenging port 31,31'. This configuration provides that the scavenging port 31,31' has a height selected so that the upper side of the piston 13, when located in the bottom dead center position, is level with the underside of the scavenging port, or protruding over only a small portion thereof.

The recess 10,10' is preferably downwards shaped in such a way that the connection between the recess 10,10' and the connecting port 8,8' is maximized because this reduces flow resistance therein. This means that when the piston 13 is located at the top dead center position, the recess 10,10' preferably reaches so far downward that a substantial entirety of the connecting port 8, 8' is uncovered by the recess 10,10' as shown in FIG. 1. As a whole, this means that a recess 10,10' in the piston 13 that meets a connecting port 8, 8' has an axial height locally at this port 8, 8' that is greater than about one and one-half times the height of the connecting port, and preferably greater than two times the height of the connecting port 8, 8'.

The relative location of a paired connecting port 8,8' and scavenging port 31,31' can be varied considerably, including being shifted sideways with respect to one another; that is, in the cylinder's tangential direction as shown in FIG. 1. FIG. 1 illustrates a configuration in which the connecting port 8,8' and the scavenging port 31,31' have an axial overlap (vertical) such that the upper edge of the connecting port 8,8' is located as high or higher in the cylinder's 15 axial direction as the lower edge of the paired scavenging port 31,31'. One advantage derived from this configuration is that the paired ports are more horizontally aligned with one another which reduces flow resistance when scavenging air is being transported from the connecting port 8,8' to the scavenging port 31,31'. Consequently, more air can flow therebetween which can enhance positive effects of this arrangement such as reducing fuel consumption and exhaust emissions.

For many two-stroke engines, the piston's upper side is level with the lower edge of the exhaust outlet and the lower edge of the scavenging port when the piston is at the bottom dead center position. It is, however, also quite common for the piston to extend a millimeter or so above the scavenging port's lower edge. According to certain aspects of the present invention, the lower edge of the scavenging port 31,31' is further lowered, an even greater axial overlap (vertical) can be created between the connecting port 8,8' and scavenging port 31,31'. When air is supplied to the transfer duct 3,3' in such a configuration, flow resistance is reduced due to both the ports being more level (horizontally) with one another and also due to the greater surface area (opening) of the scavenging port.

The present invention embodies several important principles for adapting or tuning these duct systems. One principle is that the supply of scavenging air to the transfer duct is initiated essentially at the same time as is the inlet of the engine's air/fuel-mixture to the crankcase. Another principle is that the lengths in both of the inlet systems (scavenging air and air/fuel mixture) are being tuned in relation to each other. This principle can be best explained with the aid of FIG. 2 in which an engine without any air supply system for a transfer duct is depicted. In this engine, the partition wall 36 is missing, but is shown from a theoretical perspective via the dashed line 36.

Figure 2:
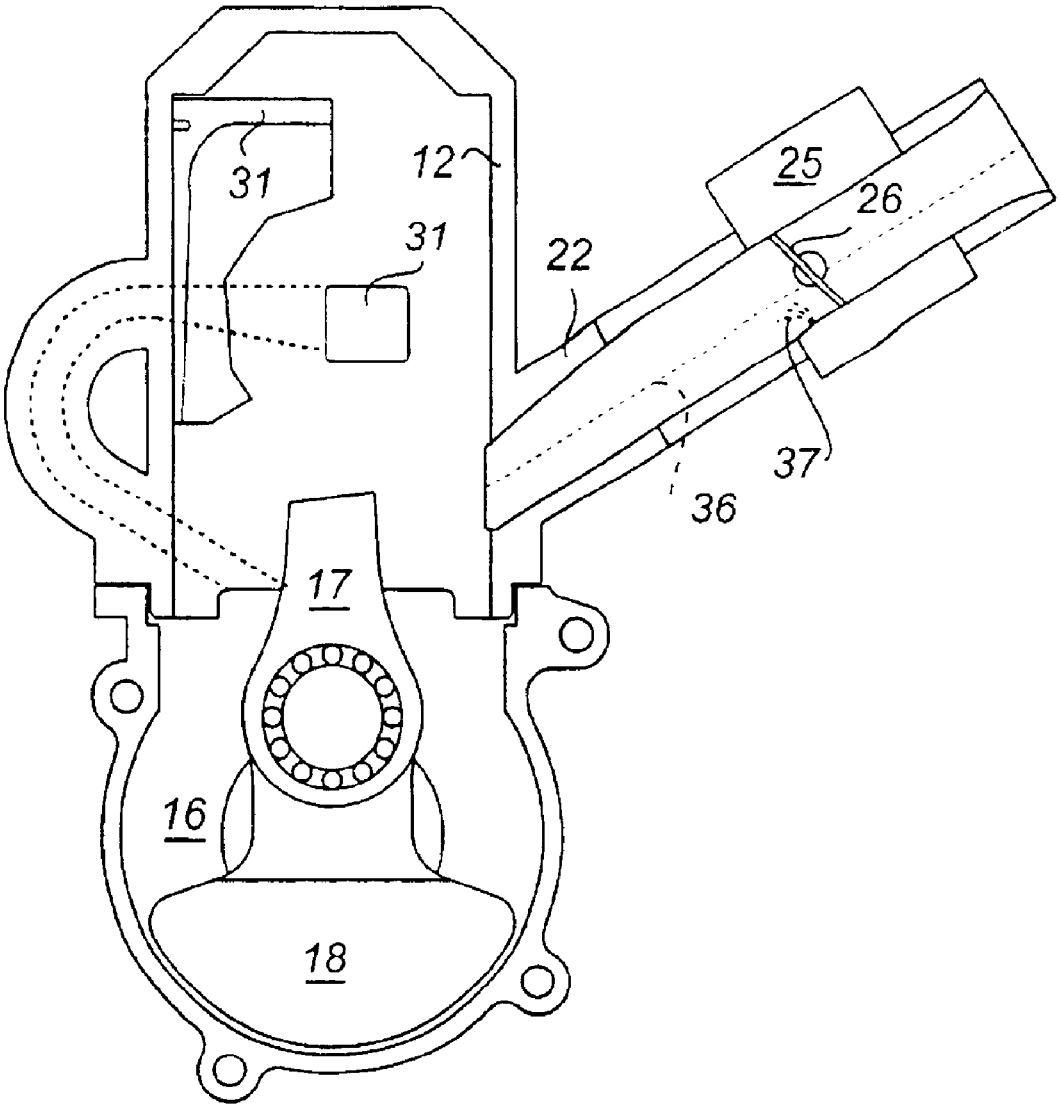
FIG. 2 shows a conventional engine. In order to facilitate explanation of the present invention, a conceivable partition wall has been figuratively located in the engine's inlet duct, as shown by dashed lines therein.

Accordingly, the engine of FIG. 2 has only one inlet tube where the entirety of the engine's air intake passes through the carburetor where the fuel flow 37 is injected and by which a desired ratio of air-to-fuel is attempted to be controlled. The inherent limitation is that the maximum amount of air that can be taken into the engine is that which can be supplied through the carburetor to the engine. Therefore, the fuel-to-air ratio is limited by the amount of air that can be taken in through the carburetor.

Consequently, when a separate system according to the present invention(s), and as depicted in FIG. 1, is arranged in order to supply the engine with air, only air will pass through the connecting duct 6 while air/fuel-mixture will pass through the inlet 22–25. According to this inventive configuration, only a smaller part of the engine's total inlet air will pass through the carburetor. Still further, the flow of fresh scavenging air in the connecting duct 6 will not affect the fuel flow 37 or mixture in the engine inlet. The duct systems for both the scavenging air and air/fuel flows can be manipulated via special tuning of the two duct systems to produce similar dynamic tuning therein. This may be simplest to understand by imagining an arrangement of a longitudinal partition wall 36 in the conventional engine as shown in FIG. 2. The partition wall 36 divides the inlet tube into two parts without changing their characteristic features, and particularly the lengths of the two parts. All of the fuel 37 is supplied to one part of the tube (below the partition wall 36). The flow in each of the two partitioned parts of the tube, which is divided by the partition wall 36, will vary in proportion to each other. In case the one flow is doubled also the other flow is doubled etc. The basic principle is that the characteristic features of the inlet tube will not be changed because of the fact that the area is separated by a longitudinal partition wall. Now, if this partition principle is migrated to FIG. 1, the engine air passage 23 is illustrated and into which all fuel 37 is supplied. This engine air passage 23 has a measured length, $L_i$, as indicated in FIG. 1. This length can be increased or decreased, as is signaled by the break-out portion marked at the outer distal end of the engine inlet tube.

The other inlet system for fresh scavenging air extends from the scavenging air inlet 2 downstream to the transfer duct's 3 exit mouth 38 at the crankcase 16. This total piston ported scavenging air passage or duct comprises two principle parts. The first part, which is designated $L_{ai}$, extends from the inlet 2 up to the mouth opening of the scavenging port 31. It thus traverses the connecting duct 6, the connecting branch 11, the connecting port 8 and finally across the flow path or recess 10 in the piston 13 to the scavenging port 31. Obviously this is on the condition that the piston 13 is located at a position at, or close to top dead center and at which the piston recess 10 comes into registration with, and connects the connecting port 8 and scavenging port 31 in fluid communication with one another.

The length of the transfer duct $L_s$, from the scavenging port 31 to the open mouth 38 at the crankcase 16, represents the last part of the piston ported scavenging air passage. The total length for this scavenging air system is thus $L_{ai}+L_s$ as shown in FIG. 1. The connecting duct 6 is illustrated in a divided mode in order to point out that a length of the duct 6 can be varied. In one example, in order to shorten the length $L_{ai}+L_s$ of the piston ported scavenging air passage, it can be suitable to place the air inlet 2 close to the outer connecting port 7 at the cylinder wall. In an example where the length $L_i$ of the engine air passage is made essentially as long as the length of the piston ported scavenging air passage; $L_{ai}+L_s$, an unchanged ratio of air/fuel can be achieved at different ranges of speed and load even if all the fuel is being supplied into the engine air passage. Though an over simplification, in principle an example of this concept would be to take the partitioned upper part of the inlet duct shown in FIG. 2, and instead place it as an air duct from the inlet 2 to the outlet 38 at the crankcase. Naturally, however, the design of the particular engine is also affected by a number of practical requirements of different nature that makes it difficult to achieve exactly the same relation between the lengths.

A preferred lengthwise proportional configuration of the two inlet systems has been discovered in which the length of the engine air passage into which fuel is added, $L_i$, is greater than about 0.6 times the total length of the combined length of the piston ported scavenging air passage, $L_{ai}$, and the transfer duct $L_s$; that is, 0.6 times ($L_{ai}$+$L_s$) but smaller than about 1.4 times the same combined length; that is, about 1.4 times ($L_{ai}$+$L_s$). A particularly advantageous proportional preference has been found to be one in which the length $L_i$ is greater than about 0.8 times the total length of the combined length of the piston ported scavenging air passage, $L_{ai}$, and the transfer duct $L_s$; that is, 0.8 times ($L_{ai}$+$L_s$) but smaller than about 1.2 times the same combined length; that is, about 1.2 times ($L_{ai}$+$L_s$).

It is important that the recess 10 in the piston, as well as the ports 8 and 31, be so arranged that the flow resistance at the passage of air between the ports 8 and 31 becomes so small that the affected tuning is not disturbed. This tuned relationship takes place primarily when both of the valves 26 and 4 are fully open. When the valves are partly closed, different conditions will become more and more predominant.

The relation between the two inlet flows at full throttle operation, or unrestricted running depends on the cross sectional area for each flow path. Preferably this is made as uniform as possible, but in case this is not possible, the cross sectional area might be regarded as an average value. Consequently, in the analogy of FIG. 2, this corresponds to where the partition wall 36 is located. In order to achieve a high degree of efficiency of the arrangement, it is preferable that a great amount of air is added through the scavenging air supply system via inlet 2. Preferably, the cross sectional area for the scavenging air flow path, with length $L_{ai}$+$L_s$, is about 100–200% of the cross sectional area for the engine inlet, with length $L_i$. By a configuration on this order, the amount of inlet air, at full throttle operation, represents approximately 50–70% of the total amount of inlet gases.

In a particularly preferred configuration, the cross sectional area for the scavenging air flow path, with length $L_{ai}$+$L_s$, is about 120–180% of the cross sectional area for the engine inlet, with length $L_i$. By a configuration on this order, the amount of inlet air, at full throttle operation, represents approximately 55–65% of the total amount of inlet gases.

The invention described hereinabove has a number of advantages. A typical standard carburetor can be used mounted in the inlet duct. Because the cross sectional area of the engine inlet duct has been halved, or more than halved, a smaller standard carburetor can be used which in turn reduces the price, volume and cost of the unit. The length of the both inlet systems can be determined during the design and manufacturing process and will not be affected by the environment or aging and thereby the air/fuel ratio will not be affected by these changing conditions and effects. By this simple arrangement, a controlled ratio of air/fuel has been achieved for the typical operating ranges of speed and load. Compared with a conventionally designed engine, only a simple type of restriction valve 4 need be added in order to regulate the amount of air provided by the combined inlet systems. This valve should be completely, or almost completely closed at idle; and then, when the throttle valve opens, the restriction valve 4 gradually opens more and more. For example, it could be actuated by a link that transfers or indicates the desirable movement based on the throttle valve's configuration.

What is claimed is:

1. An arrangement in a crankcase scavenged two-stroke internal combustion engine, said arrangement comprising:

a two-stroke internal combustion engine having a cylinder, a piston arranged for reciprocation in said cylinder, a crankcase, and a crank mechanism coupled to said piston via a connecting rod;

a piston ported air passage, with length $L_{ai}$, arranged between a scavenging air inlet and a scavenging port via a connecting duct, and said scavenging air inlet equipped with a restriction valve controlled by at least one engine parameter;

a transfer duct, with length $L_s$, extending from said scavenging port to said crankcase, said transfer duct fluidly interconnectable with said piston ported air passage via a flow path located in said piston; and a length, $L_i$, of an engine air passage measured between an engine air inlet and an air-fuel mixture port is less than one and one-half times the total length of the piston ported air passage, $L_{ai}$, plus the length of the transfer duct, $L_s$.

2. The arrangement according to claim 1, wherein said length, $L_i$, of said engine air passage is greater than one-third times the total length of the piston ported air passage, $L_{ai}$, plus the length of the transfer duct, $L_s$.

3. The arrangement according to claim 1, wherein said arrangement is further configured so that for piston positions proximate top dead center, said piston ported air passage is connected with said flow path embodied in said piston that extends to an upper part of a transfer duct, said flow path being at least partly formed by a recess in said piston that meets the scavenging port and is configured so that a scavenging air supply is given an essentially equally long period, counted as one of either crank angle and time, as an engine air supply into which fuel is added.

4. The arrangement according to claim 3, wherein said length, $L_i$, of said engine air passage is greater than 0.6 and less than 1.4 times the total length of the piston ported air passage, $L_{ai}$, plus the length of the transfer duct, $L_s$.

5. The arrangement according to claim 3, wherein said length, $L_i$, of said engine air passage is greater than 0.8 and less than 1.2 times the total length of the piston ported air passage, $L_{ai}$, plus the length of the transfer duct, $L_s$.

6. The arrangement according to claim 3, wherein said period for air supply is greater than 0.9 and less than 1.1 times the inlet period.

7. The arrangement according to claim 3, wherein said recess in said piston, when in registration with said scavenging port of said transfer duct, has a local axial height at said scavenging port that is greater than one and one-half times a height of said scavenging port.

8. The arrangement according to claim 3, wherein said recess in said piston, when in registration with said scavenging port of said transfer duct, has a local axial height at said scavenging port that is greater than two times a height of said scavenging port.

9. The arrangement according to claim 3, wherein said scavenging air inlet connects to at least two connecting ports in said wall of said engine's cylinder.

10. The arrangement according to claim 9, wherein said connecting ports are located to be covered by said piston when in a bottom dead center position.

11. The arrangement according to claim 3, wherein said connecting port is located to be uncovered by said piston when in a bottom dead center position thereby permitting exhaust gases from said cylinder to penetrate into said scavenging air inlet.

12. The arrangement according to claim 3, wherein said flow path in said piston is at least partly formed by a recess in a periphery of said piston.

13. The arrangement according to claim 3, wherein a cross sectional area of a scavenging air flow path, with length $L_{ai}+L_s$, is 100–200% of a cross sectional area for said engine air passage, with length $L_i$, thereby causing an amount of inlet engine air, at full throttle operation, to represent 50–67% of the total amount of inlet gases.

14. The arrangement according to claim 3, wherein a cross sectional area for a air flow path including said piston ported air passage and said transfer duct, said air flow path having a length $L_{ai}+L_s$, is approximately 1.2 to 1.8 times a cross sectional area for the engine air passage, with length $L_i$, thereby resulting in an amount of engine inlet air, at full throttle operation, to represent approximately 55–64% of a total amount of inlet gases.

* * * * *